US005330265A

United States Patent [19]

Keating, Jr. et al.

[11] Patent Number: 5,330,265

[45] Date of Patent: Jul. 19, 1994

[54] APPARATUS AND APPARATUS FOR MIXING AND COOLING MOLDING SAND

[75] Inventors: James P. Keating, Jr.; Leslie C. Knopp, both of Neenah, Wis.

[73] Assignee: Hartley Controls Corporation, Neenah, Wis.

[21] Appl. No.: 107,402

[22] Filed: Aug. 16, 1993

[51] Int. Cl.[5] ..... B28C 7/04; B01F 15/04; B01F 15/06

[52] U.S. Cl. ..... 366/7; 366/17; 366/25; 366/40

[58] Field of Search ..... 366/17, 6, 7, 25, 40, 366/151, 147, 167, 168, 8

[56] References Cited

U.S. PATENT DOCUMENTS 2,863,191 12/1958 Dietert ..... 366/17
2,954,215 9/1960 Warmkessel ..... 366/17
3,161,927 12/1964 Dietert ..... 366/17

*Primary Examiner*—Robert W. Jenkins
*Attorney, Agent, or Firm*—Wheeler Law Firm

[57] ABSTRACT

A process using an improved apparatus for mixing and cooling molding sand. The apparatus including a molding sand mixer that mixes molding sand and further having an adjustable water supply structure; sets of output sensors having a temperature sensor and an electrical conductivity sensor; a sand supply structure; an adjustable blower structure; and a programmable logic control (PLC), programmed to adjust the water supply structure and the blower structure in response to input from one set of output sensors, having a plurality of information inputs and command outputs connected to the adjustable water supply structure and to the adjustable blower structure; some of output sensors being in contact with a flow of molding sand from the sand supply structure and entering into the molding sand mixer and measuring the temperature and moisture content of the molding sand entering into and exiting from the molding sand mixer and being connected to the inputs of the PLC so that the PLC maintains the moisture content of the exiting sand in the range of 1-3.5% and a temperature of less than 120° F. The process requiring a constant and controlled volume of sand is furnished to the sand mixer; the hot sand mixing with the water; the sand and water being mixed with air flowing at a predetermined and controlled rate for a predetermined period of time; a set of output sensors measuring the temperature and moisture content of the sand at a discharge end of the sand mixer; the PLC receiving the temperature and moisture content of the sand at the discharge end of the mixer from the output sensors and automatically effects the changes necessary to maintain the moisture content and temperature of the exiting sand.

7 Claims, 4 Drawing Sheets

APPARATUS AND APPARATUS FOR MIXING AND COOLING MOLDING SAND

BACKGROUND OF THE INVENTION

Pug mills have been used for mixing particulate material for many years. Examples of such mills appear in U.S. Pat. Nos. 3,677,523 and 3,964,732. However, none of these mills nor any other prior art known to the inventor disclose the ability to both effectively mix and cool foundry or green molding sand.

The present invention teaches a new and unique combination of an apparatus for mixing molding sand, also called green sand, with a structure and process for keeping the molding sand within a desired predetermined temperature range and moisture content range.

Such improved control is extremely important since variations in the temperature and moisture content of the molding sand can greatly affect the characteristics of the molding sand to such an extent that the sand can become unusable if there is no accurate and thermodynamically correct method of controlling both the sands temperature and moisture content. Accordingly, it is a goal of the present invention to provide a process and a structure for accurately controlling the temperature and moisture content of the green sand.

The unique combination of structure and process of our present invention creates a cooling system that is very efficient and thus reduces the potential for too much or too little air being added to the sand. Too much air can dehydrate the bond and pull out bond and desirable fines from the sand. Further, excessive dehydration of the sand can reduce the moisture content to less than 1% and impede or make impossible cooling of the sand to the desired temperature. Too little air will result in the discharge of sand carrying too much moisture resulting in problems downstream; e.g. the sand could bind and become unflowable thereby creating a mold that is unpourable.

Consequently, it is a further objective of the present invention to produce a cooled mass of green foundry sand having an output or discharge temperature in the range of 90° F. to 120° F. and a discharge moisture content generally in the range of 1% to 3.5% where the present invention is processing sand at a rate of 100 tons per hour.

It is a further objective of the present invention to consistently produce sand having an output moisture content of substantially 2%.

Also, it is an objective of the present invention to be able to control the moisture content of the molding sand to within ±0.2% of a targeted moisture content; e.g. if the targeted moisture content were 2% then it would be desired to keep that range between 1.8% and 2.2%.

Finally, it is an objective of the present invention to control temperature of the output or discharge flow of the molding sand to ±5° F.; e.g. if the goal temperature is 115° F. then the temperature variation in the discharge sand would be between 110° F. and 120° F.

SUMMARY OF THE INVENTION

The invention is a high efficiency green sand cooler that extracts heat from sand by a combination or total of three heat transfer media. These media include: heat absorbed and carried away by air blown and drawn through a churning body of sand in a sand mixer, such as the one disclosed in our U.S. Pat. No. 3,964,732 and incorporated herein by reference; heat absorbed by water added to the sand mass during the cooling process; and heat extracted from the sand when water evaporates (i.e. heat of transformation during the phase change of water from a liquid to a gas or to a vapor).

Our thermodynamically correct formula utilizes the sum of all three heat extraction phenomena to cool sand from a measured input temperature to a predetermined output temperature. The formula is disclosed in the definition of terms.

In addition to the above noted function of the formula, the formula also calculates and automatically determines the correct amount of water necessary to be added to the sand to provide evaporative water and a specified residual water content of cooled sand leaving the device. Since air output temperature affects the amount of cooling and evaporative water required, it is also integrated into the general formula.

Our invention includes instruments that measure the following input variables: mass flow of the sand, sand input temperature, sand input water percent, air input mass flow, air input temperature, water input temperature. Sand output temperature and percent moisture are continuously monitored by thermocouples and moisture probes having sensors that produce output signals to a Programmable Logic Control (PLC), and any variation from desired or targeted parameters is corrected by a small adjustment in water addition; although, variation in the air flow rate could also be used as an additional temperature or moisture control. Finally, data is continuously examined by our bias formula that electronically and automatically tracks system performance. It then compensates for variances in output sand temperature and percentage moisture, driving these variables toward optimum, targeted conditions. With this data, our formula is used by a programmable logic control (PLC) to instantly compute and add the correct water volume to achieve the targeted output sand temperature and sand moisture percentage.

The process of the present invention may be summarized as follows: A constant and controlled volume of sand is furnished to the sand cooler. This provides a slow, even, constant feed of sand which allows accurate probing of the sand by our invention's instruments prior to entering the mixer. Our device is designed to thoroughly mix the hot sand and water immediately after the sand enters the cooler. The amount of water required to cool the sand is calculated by the water addition formula. The water requirements are then accurately added by an electronically controlled water valve. A flowmeter continuously checks to be sure the actual water added equals the desired calculated rate. The water and sand are quickly and thoroughly mixed prior to the introduction of air, thus greatly reducing loss of bond type and fine type sands in the green sand. The air is then introduced as a controlled flow that is in a direction opposite the flow or movement of the sand. The sand is retained a minimum of two (2) minutes before discharge. This allows heat to fully migrate from the center to the outside of each sand grain for full heat extraction. The vigorous mixing and lifting action of our sand cooler not only exposes the sand to air passing through the mixer, but also provides mixing and mulling of the sand. This, along with a controlled output moisture, provides "temper" to the sand before it goes to the primary mixer/muller, allowing the water and bentonite on the sand grains to preactivate. Temperature and moisture probes at the discharge end of the sand mixer monitor performance and provide instructions to the PLC to maintain the molding sand in the desired moisture range of 1-3.5% and keep the temperature of the sand at less than 120° F. This results in a closed loop system which will automatically effect air and water changes when necessary. All this contributes to a better quality molding sand and, consequently, better quality castings.

The general structure of the present invention may be summarized as an improved apparatus for mixing and cooling molding sand using a molding sand mixer that mixes molding sand. The improvement is the use of an adjustable water supply structure for variably supplying water to the molding sand in the molding sand mixer, a first set of output sensors having a temperature sensor and an electrical conductivity sensor (for measuring moisture content as a function proportional to electrical conductivity), a second set of output sensors having a temperature sensor and an electrical conductivity sensor (again to measure the moisture content), a sand supply structure for supplying molding sand to the molding sand mixer so that a substantially continuous and even flow of molding sand enters into and exits out of the molding sand mixer, an adjustable blower structure for variably blowing air into the molding sand mixer in a direction counter to the flow of sand through the sand mixer, and a programmable logic control mechanism that is programmed to independently adjust the water supply structure and the blower structure in response to input from the second set of output sensors. The programmable logic control mechanism having a plurality of information inputs and command outputs. One command output being connected to the adjustable water supply structure. Another command output being connected to the adjustable blower structure. The first set of output sensors being in contact with a flow of molding sand coming from the sand supply means and entering into the molding sand mixer. The first set of output sensors measuring the temperature and moisture content of the molding sand entering into the molding sand mixer in order to provide base line information to the PLC mechanism. The second set of output sensors being in contact with a flow of molding sand exiting the molding sand mixer. The second set of output sensors measuring the temperature and moisture content of the molding sand exiting the molding sand mixer in order to provide information to the PLC mechanism if any corrections are required. The first set of output sensors and the second set of output sensors being connected to the inputs of the programmable logic control mechanism. The programmable logic control mechanism being programmed to maintain the moisture content of the exiting sand in the range of 1-3.5% and a temperature of less than 120° F.

The present invention is designed to work in accordance with a pug mill type of mixer, as disclosed in U.S. Pat. No. 3,964,732 and incorporated by reference into the specification of the present invention, having the following important characteristics:

1. Arrangement of the paddles on the shaft in one or more helical patterns in which each paddle is at the same small oblique angle to the axis of the tub.
2. The blade portions of the paddles having a greater circumferential extent than their shank portions. The aggregate circumferential extent of the blade portions at least almost filling the space around the periphery of the tub when viewed in end elevation, thus to completely sweep the arcuate wall of the tub.
3. The shank portions of the paddles are narrower than the blade portions, thus to leave substantial gaps between the shank portions of the paddles when viewed in end elevation. Accordingly, sand in the vicinity of the shanks will be partially bypassed by the shanks for improved blending of the sand ingredients.
4. The paddles have integral axially extending base plates which are curved to match the surface of the shaft to which they are attached. Accordingly, the oblique angle of the paddles to the tub axis is positively maintained by the mechanical interlock between the paddle base plates and the shaft.
5. The mixer wall is provided with a resilient liner and the blade is provided with a resilient edge, thus to inhibit encrustation of sand on the tub wall.
6. The paddle blades include releasable clamps into which resilient wiper blades are removably received.
7. Means are provided to restrict sand flow through the tub, thus to control sand retention time in the mixer.
8. The paddle agitator is rotated at relatively high speed so that the sand is slapped and battered to cause it to fly and bounce in the tub. This aerates and ventilates the sand and removes heat therefrom, and breaks up clumps of agglomerated return sand for thorough mixing of the sand with water and blending of the sand with other additives.

Definition of Terms

For the purposes of clarity the terms given below shall be interpreted throughout the specification and the claims as having the following definitions. Should there be any contradiction between the meaning given a term herein and its common meaning that term shall be interpreted as having both meanings.

Programmable logic control mechanism-Any device, computer, etc. that is capable of functioning as or in a manner that is equivalent to a programmable logic control.

Formula-The Water Addition Formula as follows: (See next page.)

HARTLEY COOLER - WATER ADDITION FORMULA

A) Total Water Addition = Mass Flow × Water Increase % + Evaporated Water $$T_W = W_R + W_{EV}$$

B) $W_R$ = Water Retained (lb/min) = Mass Flow × Water Increase % = $MF_S \times \Delta\%$ Water C) $$W_{EV} = \text{Water Evaporated (lb/min)} = \frac{\text{Total Cooling Load (BTU)} - \text{Air Cooling (BTU)} - \text{Contact Water Cooling (BTU)}}{967}$$

$$W_{EV} = \frac{\left[\begin{array}{c}\Delta T_S \times MF_S \times .195 - \Delta T_A \times \\ MF_A \times .240 - \Delta T_{WR} \times \Delta\% \text{ Water} \times \\ MF_S - \left(\frac{210^* + T_{S(out)}}{2} - T_{W(in)}\right) W_{EV}\end{array}\right]}{967}$$

(*Use Actual $T_{S(in)}$ if < 210° F.)

Key:

$T_W$ = Total Water Add'n., lb/min $W_R$ = Water Retained, lb/min

-continued

| HARTLEY COOLER - WATER ADDITION FORMULA |
|---|
| $W_{EV}$ = Weight of Evaporated Water, lb/min |
| $MF_S$ = Mass Flow of Sand, lb/min |
| $\Delta\%$ Water = % Moisture Increase, Hundreths |
| $\Delta T_S$ = Observed Input Sand Temp. - Target Sand Temp., °F. |
| $\Delta T_A$ = Observed Output Air Temp., - Input Air Temp., °F. |
| $MF_A$ = Mass Flow of Air, lb/min (approx. = cfm × .074) |
| $\Delta T_{WR}$ = Target Ouput Sand Temp. - Input Water Temp., °F. |
| $T_{S(out)}$ = Target Sand Temp., °F. |
| $T_{S(in)}$ = Observed Input Sand Temp., °F. |
| $T_{W(in)}$ = Temp. of Input Water, °F. |
| Specific Heat Sand = .195 BTU/LB/°F. |
| Specific Heat Air = .240 BTU/LB/°F. |
| Heat of Vaporization = 967 BTU |
| Specific Heat of Water = 1 BTU/LB/°F. |

DETAILED DESCRIPTION

Although the disclosure hereof is detailed and exact to enable those reasonably skilled in the art to practice the invention, the physical embodiments herein disclosed merely exemplify the invention which may be embodied in other specific structure. The scope of the invention is defined in the claims appended hereto. The invention is a structure in process for improved cooling of molding sand for foundry work for improved temperature control and moisture control of molding sand for foundry work.

Figure 1:
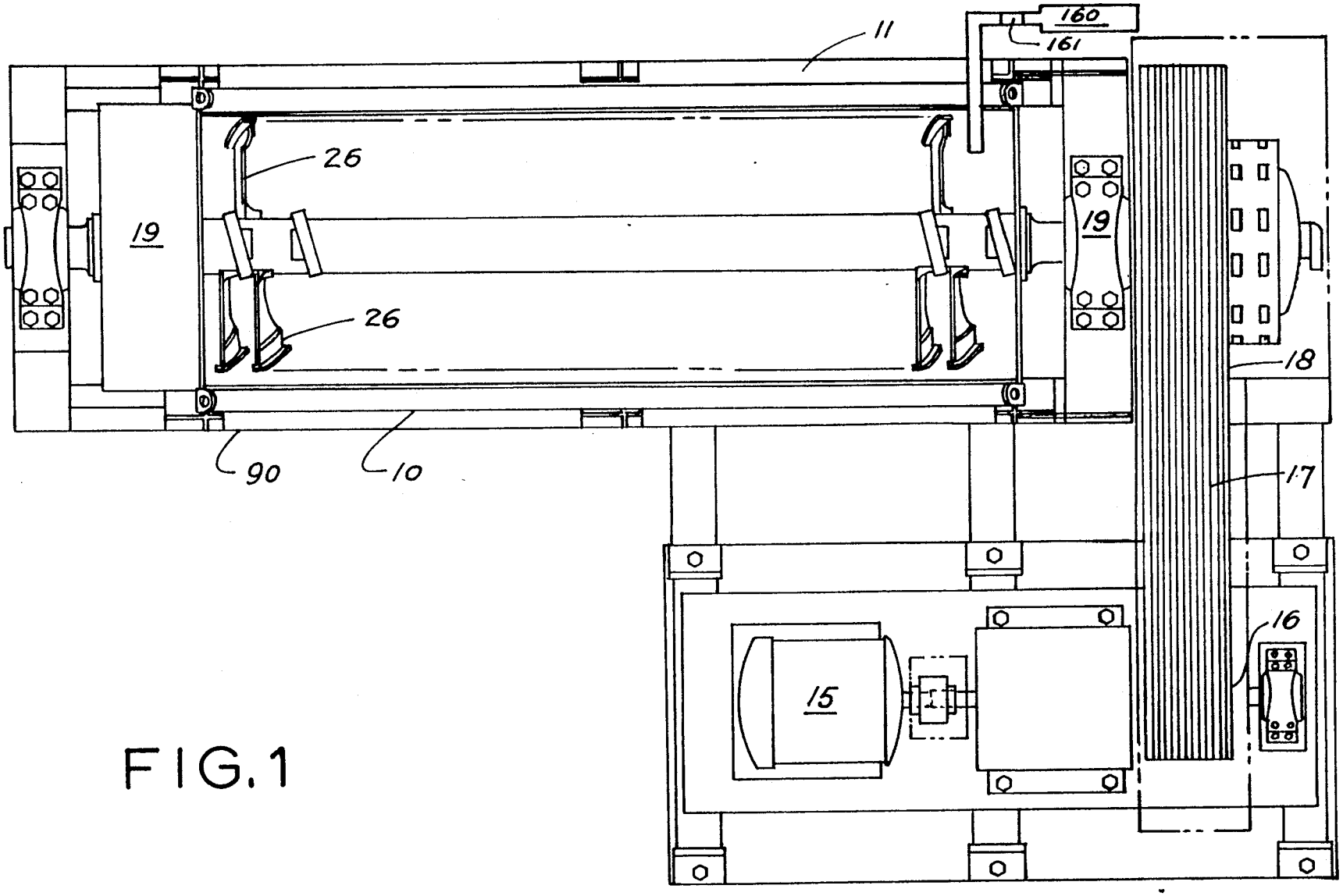
FIG. 1 is a fragmentary plan view of the mixer that is used in combination with the present invention.
Figure 4:
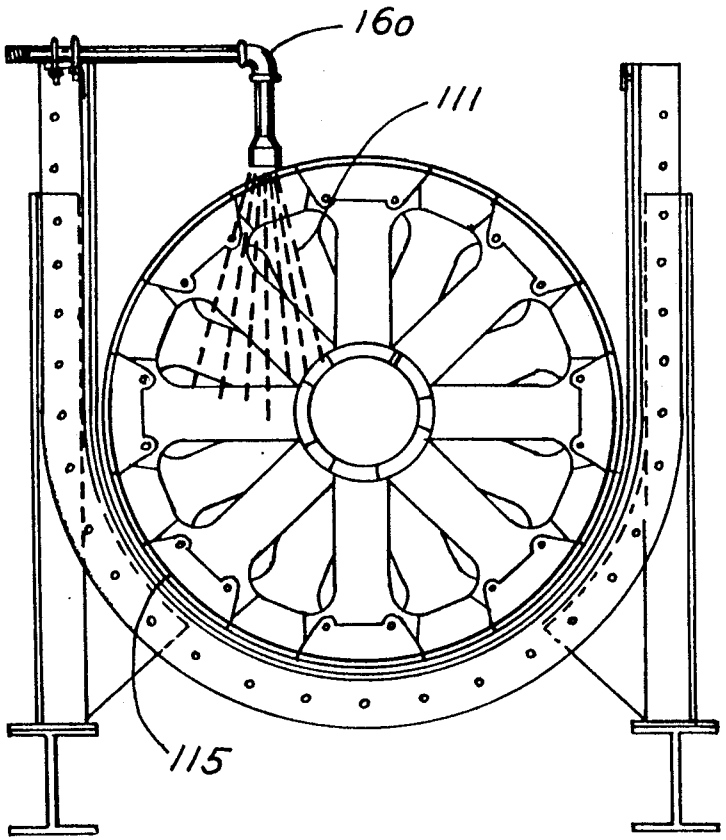
FIG. 4 is a transverse cross section taken through the tub of the mixer and showing the paddle disposition and water source jet therein.

Referring to FIGS. 1 and 4 the mixer 90 of the present invention may be seen to comprise an elongated tub shell 10 which has its upper edges stiffened by frame members 11. The tube shell 10 is supported from a base (not shown). In a typical embodiment tub 10 is 12 feet long and 3 feet wide. The tube shell 10 has horizontally spaced vertical side walls 12 extending arcuately downwardly to form a semi-cylindrical trough 13. Substantially on the axis of the trough, an agitator shaft 14 is mounted on end bearing brackets 19. The shaft 14 is driven from one end by a motor 15 coupled through a pulley 16, a belt 17, and 1 pulley wheel 18 to shaft end. The specific structure of the sand mixer disclosed herein is found in U.S. Pat. No. 3,964,732 and that structure is incorporated into the specification by reference to the text and drawings of that patent application.

Figure 2:
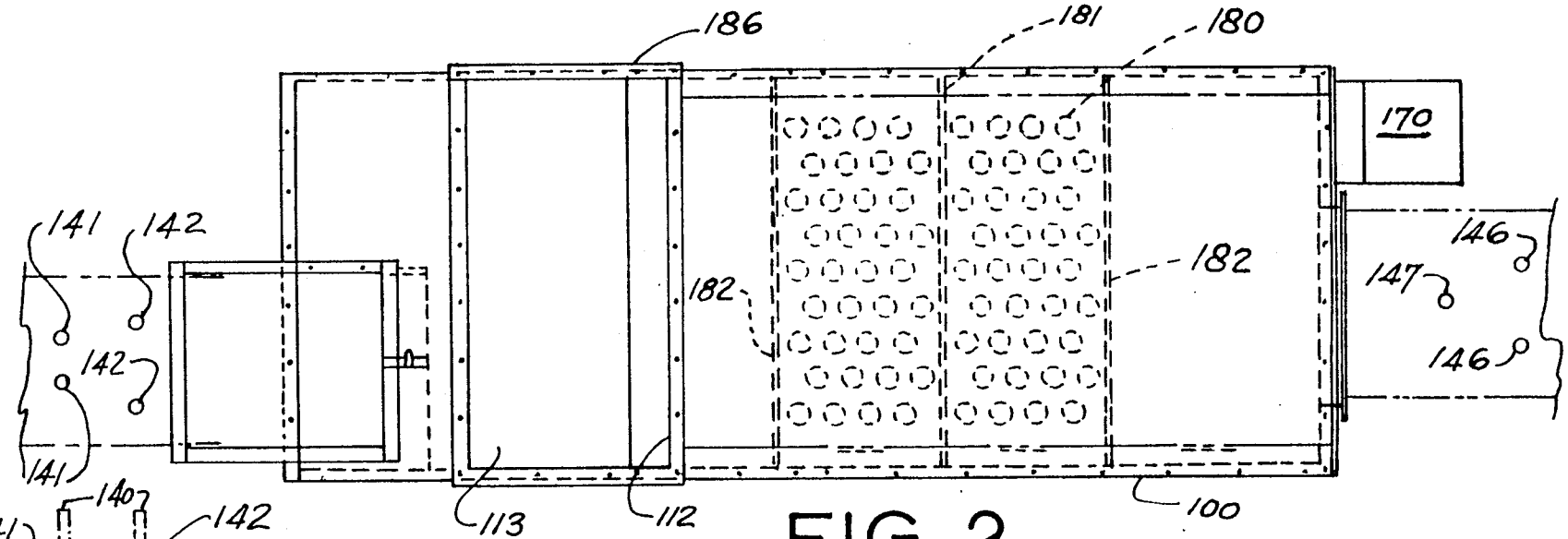
FIG. 2 is a top plan view of the present invention.
Figure 3:
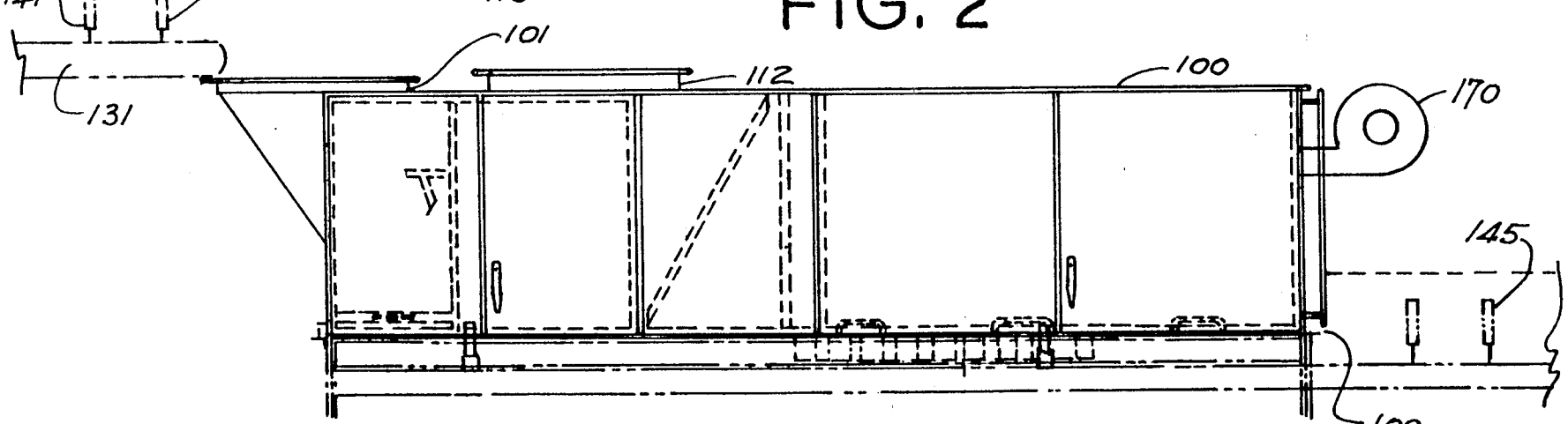
FIG. 3 is a side elevational view of the present invention.
Figure 5:
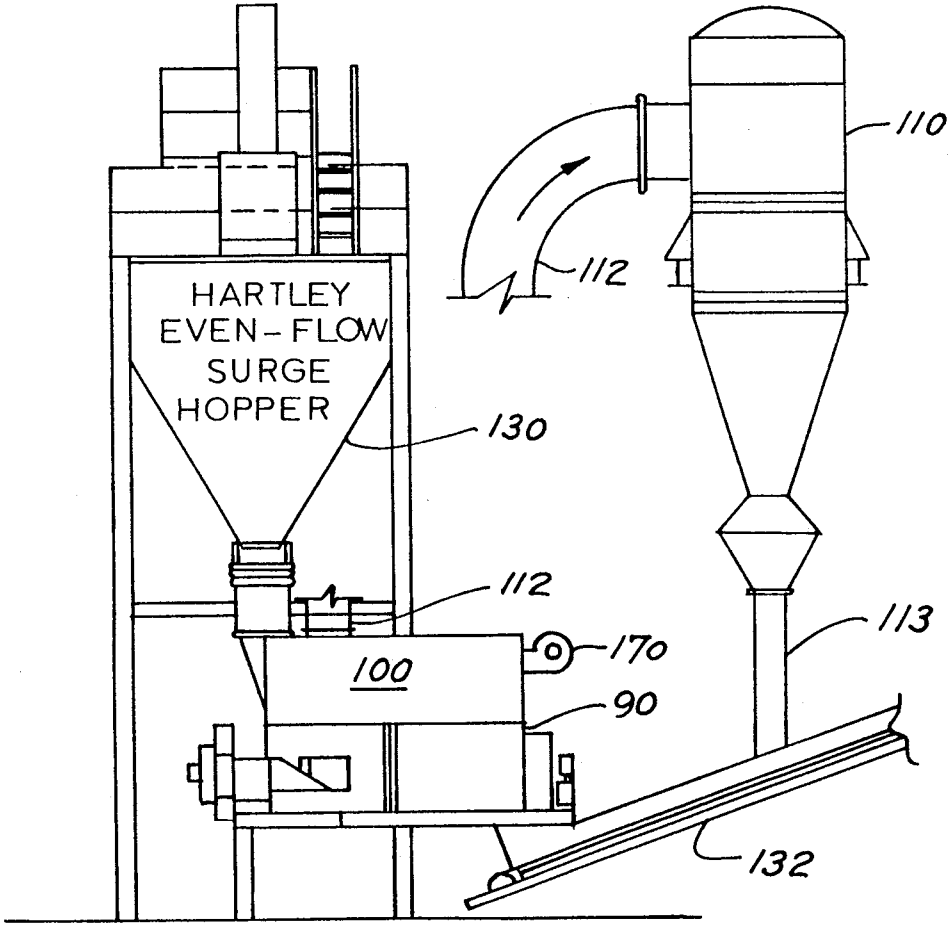
FIG. 5 is side elevational view of the present invention showing the outside structure of the present invention.

Referring to FIGS. 2, 3, and 5 the hood 100 of the present invention may be seen and referring specifically to FIG. 5 the cyclone 110 of the present invention may be seen. Referring to FIGS. 2, 3, 5, and 6 the mixer 90 may be seen to have an input or charge end 101 and output or discharge end 102.

The entire invention may be seen by examining FIGS. 2, 3, 5, and 6. The invention includes a patented Hartley Even-Flo surge hopper 130 which provides a predetermined even flow of sand 150 that is deposited on a conveyor belt 131 to a predetermined depth. This predetermined flow is used to establish the mass flow of sand. The predetermined depth of the sand 150 is at a minimum 6 inches. After being deposited on the conveyor 131 from the surge hopper sand 150 is moved on the conveyor 131 where it comes into contact with the first set of input probes or sensors 140. The sand 150 is then deposited into the mixer 90, or dryer as it is sometimes referred to, where it is mixed with a predetermined amount of water from the water input 160 prior to coming into contact with air that is blown into the mixer from a blower 170 mounted at the output end 102 of the mixer 90 so that the sand 150 moves in a direction that is opposite of the air flow 171 through the mixer.

Figure 6:
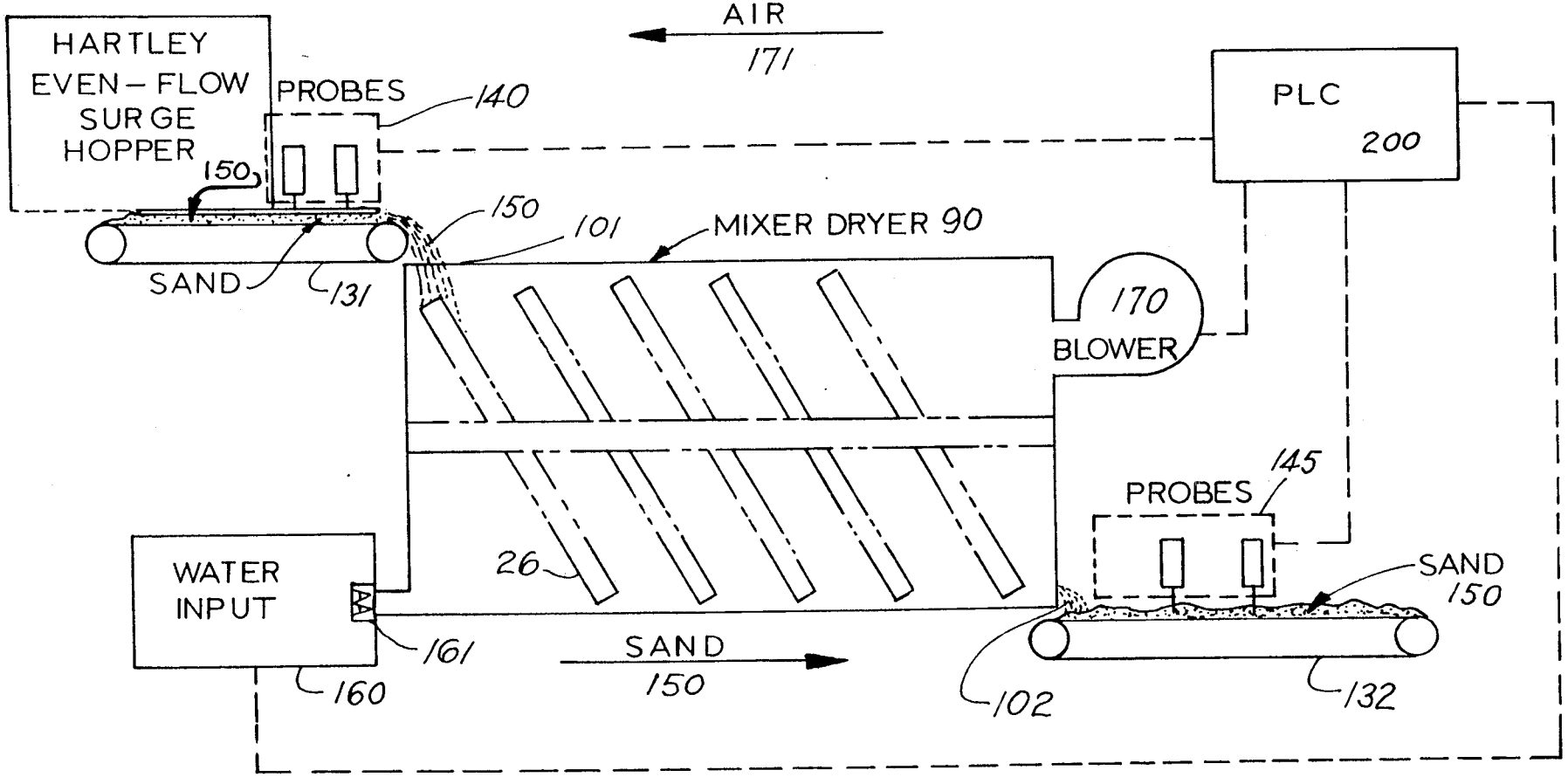
FIG. 6 is a schematic plan view showing the function and interrelation of the parts of the present invention.

Referring still to FIG. 6 but to the output end 102 of the sand mixer 90 the sand 150 may be seen to exit the mixer 90 and pass through a series of probes or sensors 145. This is the second set of output probes 145 and the sand 150 is moved past those probes 145 on a conveyor at a controlled rate of speed just as the sand 150 on the input end 101 of the mixer was moved past the first set of sensor probes 140 at a controlled rate of speed and depth. Both the first set of probes 140 and the second set of probes 145 are connected to a programmable logic control 200 (PLC 200) that has been programmed to use the formula, given in the definition of terms section, in conjunction with Series 17C Cooler software published by Hartley Controls Corporation and incorporated by reference into the present specification. However, as will be apparent to a person of ordinary skill in the art from this disclosure other software could be developed to incorporate the formula herein disclosed to operate the PLC 200 or its equivalent.

Still referring to FIGS. 5 and 6 but also to FIG. 4 it may be seen that the PLC 200 is connected to both the blower 170 and the water input 160. The PLC 200 will adjust the water input 160 by providing independent commands to an electrically controlled valve 161 that controls the flow of water from the water input 160 and/or by adjusting the amperage of the blower 170 in order to vary its speed and thus the flow of atmospheric input air 171.

The input temperature of the water from the water input 160 may be measured either by the use of a specific temperature probe connected to the PLC or it may be a predetermined constant, such as 70 degrees, that is programmed into the water addition formula disclosed herein and contained in the PLC 200. Additionally, the same is true for measurement of the air temperature of the input air into the sand mixer 90. This air temperature may be assumed to be a constant atmospheric temperature or a sensor may be added to the input air source and that information transferred to the PLC 200.

As previously noted water addition is controlled by the PLC 200. Probes 140 include thermocouples 141 and conductivity probes 142, on the conveyor belt 131 (also called a charge belt), respectively sense temperature and conductivity changes in the incoming sand 150. The change in conductivity is proportional to the percentage moisture contained within the sand. Accordingly, from these signals the PLC 200 can, using the water addition formula, determine the amount of water required to cool the sand 150 and give the desired output moisture.

Referring to FIGS. 4 and 6 it may be seen that this water is added at the charge end of the mixer 90, i.e. the sand input end 101, spraying a heavy stream of water 111 from the water input 160 through the charging sand 150 toward the corner of the downward side 112 of the mixer 90.

Air is blown into the mixer 90 by the blower 170 as previously disclosed. The sand 150 to air ratio of the sand 150 in the mixer is 3:1 by weight. Air blown into the mixer 90 is blown at approximately 13,300 cubic feet per minute (CFM), air out through the cyclone 110 is removed at a rate of approximately 16,000 cubic feet per minute (CFM). Referring to FIG. 2, the air is blown through nozzles 180 located 3 feet from the discharge end 102 of the mixer 90. These nozzles 180 are preferably 3⅛ inch in diameter by 4 inches long with an area of 7.67 square inches each for a total of 2.88 square feet (assuming there are 54 nozzles). This yields approximately 307 cfm of air per nozzle 180. The nozzles 180 are in two plates 181 that are 35 inches by 27 inches and bolted together at the ends. The nozzles 180 increase the air velocity and the air is blasted down on top of the sand 150 to evaporate the water 111 which was added to the sand 150. This is done from the hood section 100 of the mixer 190. This air is then drawn into the cyclone 110 over the top of the sand 150 picking up moisture and heat. This air is confined with steel plates over the top of the sand 150.

Air is removed from the mixer 90 through a cyclone air exhaust 112 to a dust collector (not shown). The cyclone 110 is to retain fine grains of sand in the system and prevent the dust collector from clogging up. The cyclone 110 must be sized for the CFM out of the mixer 90. A cyclone 110 for a 100 ton per hour system is typically engineered for 16,000 cubic feet per minute. The cyclone duct 112 is over the charge end 101 of the mixer 90 with a discharge 113 back into the exit conveyor 132 carrying the sand 150 that has been mixed and brought the proper moisture content.

The hood 100 of the present invention is designed to control the direction 171 of the air, confine dust, and allow access for inspection and maintenance. The air enters through the discharge end 102 of the mixer hood 100 to the nozzles 180. From the discharge end 102 of the hood 100 the first 3 feet is a plate over the mixer paddles 26. Next come the nozzles 180 with a wall 182 to form a chamber. After the nozzles 180 there is a plate over the paddles 26 to keep the air down on the sand 150. A flash off chamber 186 is over the charge area 101. At the top of the flash off chamber 186 is an opening 113 to the cyclone 110. The flash off chamber 186 should have a screen to prevent foreign material from entering the mixer 90.

The invention functions as follows:

Sand 150 is supplied from the Hartley Even-Flo surge hopper 130 onto the conveyor belt 131 at an even and uniform depth of at least 6 inches. The sand 150 is moved on the belt 131 past the first set of probes 140 and the temperature and percent of moisture content of the incoming flow of sand 150 is determined. The sand 150 is then dumped into the mixer 90 through the charge end 101. Water 111 is immediately added to the sand 150 and the mixture of sand 150 and water 111 is mixed with air 171 in the mixer 90 for a minimum of 2 minutes (assuming a sand processing rate of 100 tons per hour (TPH)).

The flow of the air 171 is kept counter to the flow of the sand 150 through the mixer 90.

Next, the sand 150 is discharged from the mixer 90 at discharge or outlet 102 onto belt 132 where it is moved past the second set of probes 145 and the temperature and moisture content of the sand 150 is again measured to determine if it is within the desired temperature and moisture parameters entered into the PLC 200; e.g. 115° F., ±5° F., in temperature and having a moisture content of 2%, ±0.2%.

The probe reading from both sets of probes are continually and automatically fed into the PLC 200, wherein the PLC 200 automatically checks these readings against the predetermined program parameters, i.e. the desired temperature and moisture content of the discharged sand 150, and makes changes to either or both the volume of water added to the sand 150 and the volume of air blown through the mixer 90, past the sand 150.

Accordingly, a continuous and constant check on the quality of the sand 150 produced may be maintained. Additionally, hard copy records of the minute to minute condition of the sand 150 may be produced by attaching the PLC 200 to a printer; e.g. a printout such as the one shown in Table 1 below may be produced.

TABLE 1

SAND SYSTEM TONS PER HOUR = 100

| TIME | TEMP IN | MOIST. IN | TEMP OUT | MOIST. OUT | SETPT | H2O NEED | H2O ADD | BIAS | AMPS | AIR TEMP OUT | | SAND TEMP OUT | SAND TEMP IN |
|---|---|---|---|---|---|---|---|---|---|---|---|---|---|
| 19:31 | 159 | 0.30 | 102 | 2.1 | 2.1 | 7.60 | 7.70 | −0.63 | 137 | 109 | X-BAR | 101.4 | 157.8 |
| 19:32 | 155 | 0.29 | 103 | 2.0 | 2.1 | 7.48 | 7.56 | −0.59 | 140 | 108 | RANGE | 3.00 | 4.00 |
| 19:33 | 158 | 0.27 | 101 | 2.1 | 2.1 | 7.63 | 7.50 | −0.60 | 136 | 108 | | | |
| 19:34 | 159 | 0.29 | 101 | 2.0 | 2.1 | 7.60 | 7.54 | −0.59 | 136 | 108 | | | |
| 19:35 | 158 | 0.27 | 100 | 2.1 | 2.1 | 7.66 | 7.54 | −0.61 | 138 | 108 | | | |
| 19:36 | 162 | 0.26 | 100 | 2.1 | 2.1 | 7.88 | 7.79 | −0.63 | 136 | 108 | X-BAR | 301.2 | 162.6 |
| 19:37 | 163 | 0.27 | 101 | 2.0 | 2.1 | 7.73 | 8.11 | −0.62 | 139 | 109 | RANGE | 2.00 | 4.00 |
| 19:38 | 162 | 0.26 | 102 | 2.0 | 2.1 | 7.83 | 7.85 | −0.60 | 138 | 109 | | | |
| 19:39 | 165 | 0.24 | 102 | 2.0 | 2.1 | 8.04 | 7.91 | −0.59 | 137 | 109 | | | |
| 19:40 | 161 | 0.26 | 101 | 2.1 | 2.1 | 7.79 | 7.83 | −0.60 | 137 | 108 | | | |
| 19:41 | 159 | 0.26 | 100 | 2.1 | 2.1 | 7.75 | 7.60 | −0.64 | 142 | 108 | X-BAR | 98.6 | 158.6 |
| 19:42 | 157 | 0.26 | 98 | 2.3 | 2.1 | 7.51 | 7.37 | −0.76 | 139 | 107 | RANGE | 2.00 | 7.00 |
| 19:43 | 156 | 0.25 | 98 | 2.2 | 2.1 | 7.44 | 7.05 | −0.83 | 139 | 108 | | | |
| 19:44 | 163 | 0.24 | 98 | 2.1 | 2.1 | 7.71 | 7.74 | −0.84 | 138 | 109 | | | |
| 19:45 | 158 | 0.26 | 99 | 2.0 | 2.1 | 7.42 | 7.56 | −0.81 | 140 | 108 | | | |

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An improved apparatus for mixing and cooling molding sand using a molding sand mixer that mixes molding sand, the improvement comprising:

an adjustable water supply means for variably supplying water to the molding sand in the molding sand mixer;

a first set of output sensors having a temperature sensor and an electrical conductivity sensor;

a second set of output sensors having a temperature sensor and an electrical conductivity sensor;

a sand supply means for supplying molding sand to the molding sand mixer so that a substantially continuous flow of molding sand enters into and exits out of the molding sand mixer;

an adjustable blower means for variably blowing air into the molding sand mixer;

and a programmable logic control mechanism, programmed to independently adjust the water supply means and the blower means in response to input from the second set of output sensors, having a plurality of information inputs and command outputs;

at least one command output being connected to the adjustable water supply means; at least one other command output being connected to the adjustable blower means;

the first set of output sensors being in contact with a flow of molding sand coming from the sand supply means and entering into the molding sand mixer; the first set of output sensors measuring the temperature and moisture content of the molding sand entering into the molding sand mixer;

the second set of output sensors being in contact with a flow of molding sand exiting the molding sand mixer; the second set of output sensors measuring the temperature and moisture content of the molding sand exiting the molding sand mixer;

the first set of output sensors and the second set of output sensors being connected to the inputs of the programmable logic control mechanism;

the programmable logic control mechanism being programmed to maintain the moisture content of the exiting sand in the range of 1-3.5% and at a temperature of less than 120° F.

2. The improved apparatus for mixing and cooling sand of claim 1 in which the programmable logic control mechanism is a programmable logic control.

3. The improved apparatus for mixing and cooling sand of claim 1 in which the programmable logic control mechanism is programmed with a formula to control the moisture content and temperature of the molding sand exiting the sand mixer.

4. An improved apparatus for mixing and cooling molding sand for use in combination with a molding sand mixer having an elongated tube having an arcuate bottom, an elongated shaft extending axially within the tub, a series of paddles mounted on the shaft and extending radially toward the tub wall, power means for rotating said shaft, said paddles having blade and shank portions, at least said blade portions being disposed at an oblique angle to the tub axis to advance sand along the tub when the shaft rotates, the blade portions of the paddles having a greater circumferential extent than the shank portions, the aggregate circumferential extent of said blade portions at least almost filling the space around the periphery of said arcuate bottom of the tub when viewed in end elevation, there being substantial gaps between said shank portions of the paddles when viewed in end elevation, whereby the blade portions will substantially completely sweep the arcuate bottom of the tub, but some of the sand in the vicinity of the shanks may be missed by the shanks and be bypassed, said tub wall being lined with a resilient material and the paddle blade portions being provided with a resilient edge, said resilient material and said resilient edge coating to inhibit sand encrustation of said wall, the improvement comprising:

an adjustable water supply means for variably supplying water to the molding sand in the molding sand mixer;

a first set of output sensors having a temperature sensor and an electrical conductivity sensor;

a second set of output sensors having a temperature sensor and an electrical conductivity sensor;

a sand supply means for supplying molding sand to the molding sand mixer so that a substantially continuous flow of molding sand enters into and exits out of the molding sand mixer;

an adjustable blower means for variably blowing air into the molding sand mixer;

and a programmable logic control mechanism, programmed to independently adjust the water supply means and the blower means in response to input from the second set of output sensors, having a plurality of information inputs and command outputs;

at least one command output being connected to the adjustable water supply means; at least one other command output being connected to the adjustable blower means;

the first set of output sensors being in contact with a flow of molding sand coming from the sand supply means and entering into the molding sand mixer; the first set of output sensors measuring the temperature and moisture content of the molding sand entering into the molding sand mixer;

the second set of output sensors being in contact with a flow of molding sand exiting the molding sand mixer; the second set of output sensors measuring the temperature and moisture content of the molding sand exiting the molding sand mixer;

the first set of output sensors and the second set of output sensors being connected to the inputs of the programmable logic control mechanism;

the programmable logic control mechanism being programmed to maintain the moisture content of the exiting sand in the range of 1-3.5%.

5. A process for controlling the temperature and moisture content of molding sand, the process using an improved apparatus for mixing and cooling molding sand, including a molding sand mixer that mixes molding sand, having an adjustable water supply means for variably supplying water to the molding sand in the molding sand mixer; a first set of output sensors having a temperature sensor and an electrical conductivity sensor; a second set of output sensors having a temperature sensor and an electrical conductivity sensor; a sand supply means for supplying molding sand to the molding sand mixer so that a substantially continuous flow of molding sand enters into and exits out of the molding sand mixer; an adjustable blower means for variably blowing air into the molding sand mixer; and a programmable logic control mechanism, programmed to independently adjust the water supply means and the blower means in response to input from the second set of output sensors, having a plurality of information inputs and command outputs; at least one command output being connected to the adjustable water supply means; at least one other command output being connected to the adjustable blower means; the first set of output sensors being in contact with a flow of molding sand coming from the sand supply means and entering into the molding sand mixer; the first set of output sensors measuring the temperature and moisture content of the molding sand entering into the molding sand mixer; the second set of output sensors being in contact with a flow of molding sand exiting the molding sand mixer; the second set of output sensors measuring the temperature and moisture content of the molding sand exiting the molding sand mixer; the first set of output sensors and the second set of output sensors being connected to the inputs of the programmable logic control mechanism; the programmable logic control mechanism being programmed to maintain the moisture content of the exiting sand in the range of 1–3.5% and a temperature of less than 120° F., the process of the present invention comprising: a first step in which a constant and controlled volume of sand is furnished to the sand mixer; a second step in which the hot sand is mixed with water pursuant to a water addition formula prior to the introduction of air; a third step in which the sand and water are mixed with an air flow at a predetermined rate for a predetermined period of time; a fourth step in which the second set of output sensors measure the temperature and moisture content of the sand at a discharge end of the sand mixer; a fifth step in which the programmable logic control mechanism receives the temperature and moisture content of the sand at the discharge end of the sand mixer from the second set of output sensors and automatically effects air and water changes necessary to maintain the moisture content of the exiting sand in the range of 1–3.5% and a temperature of less than 120° F.

6. The predetermined period of time of claim 5 being at least two (2) minutes.

7. The mixed sand and water of claim 5 flowing in a direction opposite the air flow.

* * * * *

UNITED STATES PATENT AND TRADEMARK OFFICE

CERTIFICATE OF CORRECTION

PATENT NO. : 5,330,265

DATED : 19 July 1994

INVENTOR(S) : James P. Keating, Jr., Leslie C. Knopp

It is certified that error appears in the above-indentified patent and that said Letters Patent is hereby corrected as shown below:

Title page, item [54], and col. 1, line 1,

In the title delete "Apparatus" second occurrence and insert --Process--.

Signed and Sealed this

Twenty-eight Day of March, 1995

*Attest:*

Bruce Lehman

BRUCE LEHMAN

*Attesting Officer*

*Commissioner of Patents and Trademarks*